US012630281B2

(12) United States Patent
Ikegaya

(10) Patent No.: US 12,630,281 B2
(45) Date of Patent: May 19, 2026

(54) MARINE PROPULSION SYSTEM AND MARINE VESSEL

(71) Applicant: YAMAHA HATSUDOKI KABUSHIKI KAISHA, Iwata (JP)

(72) Inventor: Yuji Ikegaya, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 844 days.

(21) Appl. No.: 17/970,619

(22) Filed: Oct. 21, 2022

(65) Prior Publication Data

US 2023/0140720 A1 May 4, 2023

(30) Foreign Application Priority Data

Nov. 4, 2021 (JP) ..... 2021-180206

(51) Int. Cl.
*B63H 25/42* (2006.01)
*B63H 21/21* (2006.01)
*B63H 25/02* (2006.01)

(52) U.S. Cl.
CPC ..... *B63H 25/42* (2013.01); *B63H 21/21* (2013.01); *B63H 2021/216* (2013.01); *B63H 25/02* (2013.01); *B63H 2025/026* (2013.01)

(58) Field of Classification Search
CPC ..... B63H 21/21; B63H 25/42; B63H 25/02
See application file for complete search history.

(56) References Cited

U.S. PATENT DOCUMENTS 4,573,930 A * 3/1986 Queen ..... F16B 2/08 440/63
2010/0151750 A1* 6/2010 Ito ..... B63H 20/10 440/1
2014/0156124 A1* 6/2014 Hara ..... B63H 25/02 701/21
2015/0166159 A1* 6/2015 Inoue ..... B63H 20/12 440/53

(Continued)

FOREIGN PATENT DOCUMENTS

EP 3000718 A1 3/2016
EP 3722201 A1 10/2020

(Continued)

OTHER PUBLICATIONS

Extended European Search Report in EP22205548.5, mailed Apr. 12, 2023, 7 pages.

*Primary Examiner* — S. Joseph Morano
*Assistant Examiner* — Jovon E Hayes
(74) *Attorney, Agent, or Firm* — Keating & Bennett, LLP

(57) ABSTRACT

A marine propulsion system includes a main propulsion device operable to rotate in a right-left direction to change a direction of a thrust, an auxiliary propulsion device including an electric motor to drive an auxiliary thruster to generate a thrust, operable to rotate in the right-left direction to change a direction of the thrust, and having a maximum output smaller than a maximum output of the main propulsion device, and a controller configured or programmed to perform a fixed point holding control to maintain an orientation of a bow of the hull at a target orientation and maintain a position of the hull at a target point by causing the main propulsion device and the auxiliary propulsion device to cooperate with each other.

20 Claims, 6 Drawing Sheets

(56) References Cited

U.S. PATENT DOCUMENTS

| | | | | |
|---|---|---|---|---|
| 2018/0015994 | A1 | 1/2018 | Kishimoto et al. | |
| 2019/0179318 | A1* | 6/2019 | Miller | B63H 25/42 |
| 2019/0353093 | A1* | 11/2019 | Ito | B63H 20/12 |
| 2021/0004007 | A1* | 1/2021 | Fujima | B63B 79/15 |
| 2023/0140720 | A1* | 5/2023 | Ikegaya | B63H 20/12 440/1 |
| 2024/0132194 | A1* | 4/2024 | Ikegaya | B63H 25/02 |
| 2024/0227998 | A9* | 7/2024 | Ikegaya | B63H 21/17 |

FOREIGN PATENT DOCUMENTS

| | | | | | |
|---|---|---|---|---|---|
| JP | 2000-344193 | A | | 12/2000 | |
| JP | 2020168921 | A | * | 10/2020 | B63H 5/125 |

* cited by examiner

MARINE PROPULSION SYSTEM AND MARINE VESSEL

CROSS REFERENCE TO RELATED APPLICATIONS

This application claims the benefit of priority to Japanese Patent Application No. 2021-180206 filed on Nov. 4, 2021. The entire contents of this application are hereby incorporated herein by reference.

BACKGROUND OF THE INVENTION

1. Field of the Invention

The present invention relates to a marine propulsion system and a marine vessel.

2. Description of the Related Art

A marine propulsion system including a main propulsion device and an auxiliary propulsion device, both of which are attached to the stern of a hull, is known in general. Such a marine propulsion system is disclosed in Japanese Patent Laid-Open No. 2000-344193, for example.

Japanese Patent Laid-Open No. 2000-344193 discloses an automatic return navigation device including a main propulsion device attached to the stern of a hull, an auxiliary propulsion device attached to the stern of the hull, and a controller that performs a control to maintain the hull at a target point specified by a user. When a distance from the hull to the target point exceeds a predetermined distance with the main and auxiliary propulsion devices stopped, the controller drives only the auxiliary propulsion device to move (return) the hull to the target point. The controller stops the auxiliary propulsion device again when the hull returns to the target point. In the control to return the hull to the target point, only the auxiliary propulsion device is driven instead of driving both the main propulsion device and the auxiliary propulsion device.

Although not clearly described in Japanese Patent Laid-Open No. 2000-344193, conventionally, there has been known a fixed point holding (Stay Point™) control to maintain the orientation of a bow at a target orientation specified by a user and maintain the position of a hull at a target point specified by the user. When the control to return the hull to the target point described in Japanese Patent Laid-Open No. 2000-344193 is applied to such a fixed point holding control, a control is conceivably performed to drive only the auxiliary propulsion device instead of driving both the main propulsion device and the auxiliary propulsion device. However, in such a case, it is conceivably difficult for only the auxiliary propulsion device to move the hull while maintaining the orientation of the bow required for normal fixed point holding. In recent years, in the field of marine vessels, from the viewpoint of SDGs (Sustainable Development Goals), it is desired to reduce environmental burdens, such as reducing the amount of carbon dioxide emissions associated with driving of propulsion devices of marine vessels.

SUMMARY OF THE INVENTION

Preferred embodiments of the present invention provide marine propulsion systems and marine vessels that each achieve fixed point holding of hulls including main propulsion devices and auxiliary propulsion devices while reducing or minimizing environmental burdens associated with driving of propulsion devices.

A marine propulsion system according to a preferred embodiment of the present invention includes a main propulsion device to be attached to a stern of a hull and operable to rotate in a right-left direction to change a direction of a thrust, an auxiliary propulsion device to be attached to the stern, including an electric motor to drive an auxiliary thruster to generate a thrust, operable to rotate in the right-left direction to change a direction of the thrust, and having a maximum output smaller than a maximum output of the main propulsion device, and a controller configured or programmed to perform a fixed point holding control to maintain an orientation of a bow of the hull at a target orientation and maintain a position of the hull at a target point by causing the main propulsion device and the auxiliary propulsion device to cooperate with each other.

A marine propulsion system according to a preferred embodiment of the present invention includes the controller configured or programmed to perform the fixed point holding (Stay Point™) control to maintain the orientation of the bow of the hull at the target orientation and maintain the position of the hull at the target point by causing the main propulsion device and the auxiliary propulsion device to cooperate with each other. Accordingly, unlike a case in which only the auxiliary propulsion device is driven in the fixed point holding control, the main propulsion device and the auxiliary propulsion device are caused to cooperate with each other to flexibly rotate and move the hull so as to maintain the orientation of the bow of the hull at the target orientation and maintain the position of the hull at the target point. Furthermore, the auxiliary propulsion device includes the electric motor to drive the auxiliary thruster to generate a thrust. Accordingly, as compared with a case in which the main propulsion device is driven and the auxiliary propulsion device is an engine propulsion device, the amount of carbon dioxide emitted from the auxiliary propulsion device is reduced. Thus, the hull including the main propulsion device and the auxiliary propulsion device is held at a fixed point while environmental burdens associated with driving of the auxiliary propulsion device are reduced or minimized.

In a marine propulsion system according to a preferred embodiment of the present invention, the main propulsion device is preferably provided on a centerline of the hull in the right-left direction, and the auxiliary propulsion device is preferably provided to one side of the centerline of the hull in the right-left direction. Accordingly, in a marine vessel including the main propulsion device provided on the centerline of the hull in the right-left direction, and the auxiliary propulsion device provided to one side of the centerline of the hull in the right-left direction, the main propulsion device and the auxiliary propulsion device are caused to cooperate with each other to flexibly rotate and move the hull, and thus the directions and magnitudes of the thrusts of the main propulsion device and the auxiliary propulsion device are adjusted in the fixed point holding control.

In a marine propulsion system according to a preferred embodiment of the present invention, the auxiliary propulsion device preferably has a right-left rotatable angle range to change the direction of the thrust larger than a right-left rotatable angle range of the main propulsion device, and the controller is preferably configured or programmed to rotate the hull by driving the auxiliary propulsion device in the fixed point holding control. Accordingly, the hull is rotated (pivot-turned) by the electric motor-driven (electric) auxiliary propulsion device that has the right-left rotatable angle range to change the direction of the thrust larger than the right-left rotatable angle range of the main propulsion device such that a change in the position of the hull becomes smaller.

In a marine propulsion system according to a preferred embodiment of the present invention, the main propulsion device preferably includes an engine to drive a main thruster to generate a thrust and having a maximum value and a minimum value of a power range larger than a maximum value and a minimum value of a power range of the electric motor, and the controller is preferably configured or programmed to limit the power range of the engine by matching an upper limit value of the power range of the engine with the maximum value of the power range of the electric motor while the main propulsion device and the auxiliary propulsion device are caused to cooperate with each other to move the hull, and to limit the power range of the electric motor by matching a lower limit value of the power range of the electric motor with the minimum value of the power range of the engine while the main propulsion device and the auxiliary propulsion device are caused to cooperate with each other to move the hull. Accordingly, the power range of the engine and the power range of the electric motor are adjusted to be equivalent or substantially equivalent to each other, and thus when the main propulsion device and the auxiliary propulsion device are caused to cooperate with each other, the output of the engine and the output of the electric motor are prevented from being out of balance.

In a marine propulsion system according to a preferred embodiment of the present invention, the controller is preferably configured or programmed to rotate the hull by driving the auxiliary thruster to generate the thrust from the auxiliary propulsion device while a main thruster operable to generate a thrust from the main propulsion device is stopped when the hull is rotated to maintain the orientation of the bow at the target orientation in the fixed point holding control. Accordingly, the hull is rotated only by the electric auxiliary propulsion device, and thus the hull is quietly rotated. Furthermore, a thrust is generated only from the electric motor-driven (electric) auxiliary propulsion device during rotation of the hull, and thus environmental burdens during rotation of the hull are reduced.

In such a case, the controller is preferably configured or programmed to rotate the hull about a center of gravity of the hull on the spot while holding the position of the hull. Accordingly, the hull is rotated on the spot without changing the position of the hull, and thus the accuracy of maintaining the target point in the fixed point holding control is improved.

In a marine propulsion system according to a preferred embodiment of the present invention, the controller is preferably configured or programmed to, when the hull is moved to maintain the position of the hull at the target point in the fixed point holding control, move the hull laterally or diagonally while maintaining the orientation of the bow by simultaneously driving a main thruster to generate the thrust from the main propulsion device and the auxiliary thruster to generate the thrust from the auxiliary propulsion device, and move the hull in a forward-rearward direction by driving the main thruster while the auxiliary thruster is stopped. Accordingly, the main thruster and the auxiliary thruster are simultaneously driven (caused to cooperate with each other) such that the hull is moved laterally or diagonally while the orientation of the bow is maintained, and the hull is moved in the forward-rearward direction by driving only the main thruster.

In such a case, the controller is preferably configured or programmed to move the hull laterally or diagonally while maintaining the orientation of the bow by positioning an intersection of an output vector of the main thruster and an output vector of the auxiliary thruster on a straight line extending through a center of gravity of the hull and the target point and setting, in a direction from the center of gravity to the target point, a direction of a resultant force of the output vector of the main thruster and the output vector of the auxiliary thruster that indicates a moving direction of the hull. Accordingly, even when the main propulsion device and the auxiliary propulsion device are not provided in a well-balanced manner with respect to the centerline of the hull in the right-left direction, the hull is moved laterally or diagonally while the orientation of the bow is maintained.

In a marine propulsion system in which the main thruster and the auxiliary thruster are simultaneously driven to move the hull laterally or diagonally while the orientation of the bow is maintained, the controller is preferably configured or programmed to cause a direction of an output vector of the main thruster and a direction of an output vector of the auxiliary thruster to be opposite to each other in the forward-rearward direction when the hull is moved laterally or diagonally while the orientation of the bow is maintained. Accordingly, the direction of the output vector of the main thruster and the direction of the output vector of the auxiliary thruster are opposite to each other, and thus the hull is easily moved laterally or diagonally while the orientation of the bow is maintained.

In a marine propulsion system according to a preferred embodiment of the present invention, the controller is preferably configured or programmed to perform a control to rotate the hull to maintain the orientation of the bow at the target orientation and a control to move the hull to maintain the position of the hull at the target point at different timings in the fixed point holding control. Accordingly, rotating the hull to maintain the orientation of the bow at the target orientation and moving the hull to maintain the position of the hull at the target point are separated from each other such that a change in the position of the hull during rotation of the hull is reduced or prevented, and a change in the orientation of the bow during movement of the hull is reduced or prevented.

In a marine propulsion system according to a preferred embodiment of the present invention, the main propulsion device is preferably an engine outboard motor including an engine to drive a main propeller to generate a thrust and provided on a centerline of the hull in the right-left direction, and the auxiliary propulsion device is preferably an electric outboard motor including the electric motor to drive an auxiliary propeller corresponding to the auxiliary thruster and provided to one side of the centerline of the hull in the right-left direction. Accordingly, environmental burdens are reduced due to driving of the electric outboard motor, and the hull including the engine outboard motor and the electric outboard motor is held at a fixed point.

A marine propulsion system according to a preferred embodiment of the present invention includes a main propulsion device to be attached to a stern of a hull and operable to rotate in a right-left direction to change a direction of a thrust, an auxiliary propulsion device to be attached to the stern, operable to rotate in the right-left direction to change a direction of a thrust, and having a maximum output smaller than a maximum output of the main propulsion device, and a controller configured or programmed to perform a fixed point holding control to maintain an orientation of a bow of the hull at a target orientation and maintain a position of the hull at a target point by causing the main propulsion device and the auxiliary propulsion device to cooperate with each other.

A marine propulsion system according to a preferred embodiment of the present invention includes the controller configured or programmed to perform the fixed point holding (Stay Point™) control to maintain the orientation of the bow of the hull at the target orientation and maintain the position of the hull at the target point by causing the main propulsion device and the auxiliary propulsion device to cooperate with each other. Accordingly, unlike a case in which only the auxiliary propulsion device is driven in the fixed point holding control, the main propulsion device and the auxiliary propulsion device are caused to cooperate with each other to flexibly rotate and move the hull so as to maintain the orientation of the bow of the hull at the target orientation and maintain the position of the hull at the target point. Consequently, the hull including the main propulsion device and the auxiliary propulsion device is held at a fixed point.

A marine vessel according to a preferred embodiment of the present invention includes a hull, and a marine propulsion system provided on or in the hull. The marine propulsion system includes a main propulsion device attached to a stern of the hull and operable to rotate in a right-left direction to change a direction of a thrust, an auxiliary propulsion device attached to the stern, including an electric motor to drive an auxiliary thruster to generate a thrust, operable to rotate in the right-left direction to change a direction of the thrust, and having a maximum output smaller than a maximum output of the main propulsion device, and a controller configured or programmed to perform a fixed point holding control to maintain an orientation of a bow of the hull at a target orientation and maintain a position of the hull at a target point by causing the main propulsion device and the auxiliary propulsion device to cooperate with each other.

A marine vessel according to a preferred embodiment of the present invention includes the controller configured or programmed to perform the fixed point holding (Stay Point™) control to maintain the orientation of the bow of the hull at the target orientation and maintain the position of the hull at the target point by causing the main propulsion device and the auxiliary propulsion device to cooperate with each other. Accordingly, unlike a case in which only the auxiliary propulsion device is driven in the fixed point holding control, the main propulsion device and the auxiliary propulsion device are caused to cooperate with each other to flexibly rotate and move the hull so as to maintain the orientation of the bow of the hull at the target orientation and maintain the position of the hull at the target point. Furthermore, the auxiliary propulsion device includes the electric motor to drive the auxiliary thruster to generate a thrust. Accordingly, as compared with a case in which the main propulsion device is driven and the auxiliary propulsion device is an engine propulsion device, the amount of carbon dioxide emitted from the auxiliary propulsion device is reduced. Thus, the hull including the main propulsion device and the auxiliary propulsion device is held at a fixed point while environmental burdens associated with driving of the auxiliary propulsion device are reduced or minimized.

In a marine vessel according to a preferred embodiment of the present invention, the main propulsion device is preferably provided on a centerline of the hull in the right-left direction, and the auxiliary propulsion device is preferably provided to one side of the centerline of the hull in the right-left direction. Accordingly, in the marine vessel including the main propulsion device provided on the centerline of the hull in the right-left direction, and the auxiliary propulsion device provided to one side of the centerline of the hull in the right-left direction, the main propulsion device and the auxiliary propulsion device are caused to cooperate with each other to flexibly rotate and move the hull, and thus the directions and magnitudes of the thrusts of the main propulsion device and the auxiliary propulsion device are adjusted in the fixed point holding control.

In a marine vessel according to a preferred embodiment of the present invention, the auxiliary propulsion device preferably has a right-left rotatable angle range to change the direction of the thrust larger than a right-left rotatable angle range of the main propulsion device, and the controller is preferably configured or programmed to rotate the hull by driving the auxiliary propulsion device in the fixed point holding control. Accordingly, the hull is rotated (pivot-turned) by the electric motor-driven (electric) auxiliary propulsion device that has the right-left rotatable angle range to change the direction of the thrust larger than the right-left rotatable angle range of the main propulsion device such that a change in the position of the hull becomes smaller.

In a marine vessel according to a preferred embodiment of the present invention, the main propulsion device preferably includes an engine to drive a main thruster to generate a thrust and having a maximum value and a minimum value of a power range larger than a maximum value and a minimum value of a power range of the electric motor, and the controller is configured or programmed to limit the power range of the engine by matching an upper limit value of the power range of the engine with the maximum value of the power range of the electric motor while the main propulsion device and the auxiliary propulsion device are caused to cooperate with each other to move the hull, and limit the power range of the electric motor by matching a lower limit value of the power range of the electric motor with the minimum value of the power range of the engine while the main propulsion device and the auxiliary propulsion device are caused to cooperate with each other to move the hull. Accordingly, the power range of the engine and the power range of the electric motor are adjusted to be equivalent or substantially equivalent to each other, and thus when the main propulsion device and the auxiliary propulsion device are caused to cooperate with each other, the output of the engine and the output of the electric motor are prevented from being out of balance.

In a marine vessel according to a preferred embodiment of the present invention, the controller is preferably configured or programmed to rotate the hull by driving the auxiliary thruster to generate the thrust from the auxiliary propulsion device while a main thruster operable to generate a thrust from the main propulsion device is stopped when the hull is rotated to maintain the orientation of the bow at the target orientation in the fixed point holding control. Accordingly, the hull is rotated only by the electric auxiliary propulsion device, and thus the hull is quietly rotated. Furthermore, a thrust is generated only from the electric motor-driven (electric) auxiliary propulsion device during rotation of the hull, and thus environmental burdens during rotation of the hull are reduced.

In such a case, the controller is preferably configured or programmed to rotate the hull about a center of gravity of the hull on the spot while holding the position of the hull. Accordingly, the hull is rotated on the spot without changing the position of the hull, and thus the accuracy of maintaining the target point in the fixed point holding control is improved.

In a marine vessel according to a preferred embodiment of the present invention, the controller is preferably configured or programmed to, when the hull is moved to maintain the position of the hull at the target point in the fixed point holding control, move the hull laterally or diagonally while maintaining the orientation of the bow by simultaneously driving a main thruster to generate the thrust from the main propulsion device and the auxiliary thruster to generate the thrust from the auxiliary propulsion device, and move the hull in a forward-rearward direction by driving the main thruster while the auxiliary thruster is stopped. Accordingly, the main thruster and the auxiliary thruster are simultaneously driven (caused to cooperate with each other) such that the hull is moved laterally or diagonally while the orientation of the bow is maintained, and the hull is moved in the forward-rearward direction by driving only the main thruster.

In such a case, the controller is preferably configured or programmed to move the hull laterally or diagonally while maintaining the orientation of the bow by positioning an intersection of an output vector of the main thruster and an output vector of the auxiliary thruster on a straight line extending through a center of gravity of the hull and the target point and setting, in a direction from the center of gravity to the target point, a direction of a resultant force of the output vector of the main thruster and the output vector of the auxiliary thruster that indicates a moving direction of the hull. Accordingly, even when the main propulsion device and the auxiliary propulsion device are not provided in a well-balanced manner with respect to the centerline of the hull in the right-left direction, the hull is moved laterally or diagonally while the orientation of the bow is maintained.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

The structure of a marine vessel 100 including a marine propulsion system 102 according to preferred embodiments of the present invention is now described with reference to FIGS. 1 to 11.

In the figures, arrow FWD represents the forward movement direction of the marine vessel 100 in a forward-rearward direction, and arrow BWD represents the rearward movement direction of the marine vessel 100 in the forward-rearward direction. Arrow R represents the starboard direction of the marine vessel 100 in a right-left direction (a direction perpendicular to the forward-rearward direction), and arrow L represents the portside direction of the marine vessel 100 in the right-left direction.

Figure 1:
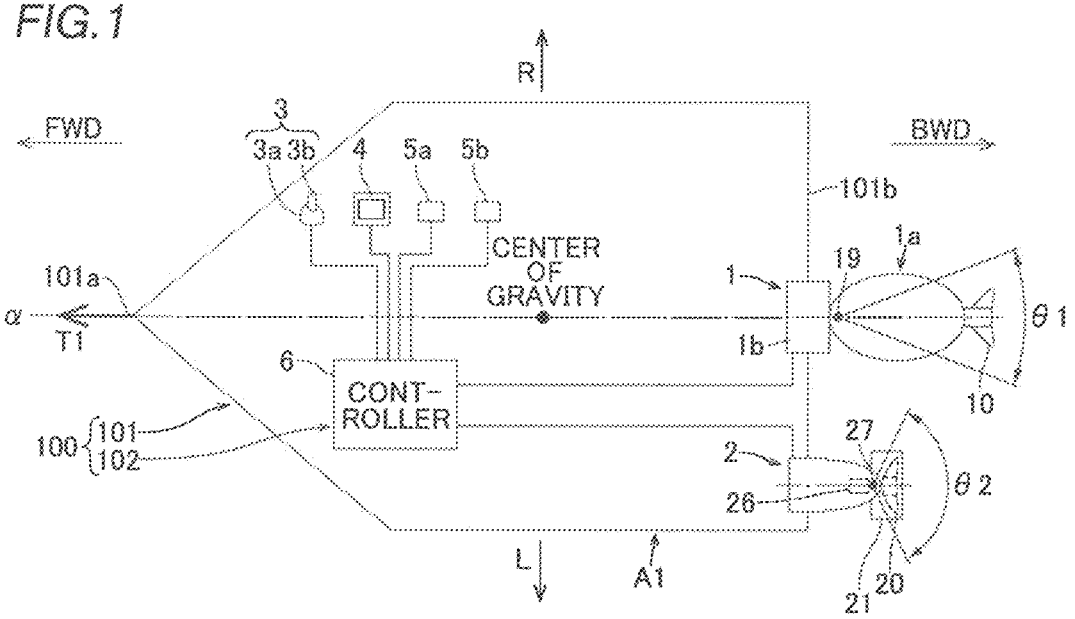
FIG. 1 is a schematic view showing a marine vessel including a marine propulsion system and a hull according to a preferred embodiment of the present invention.

As shown in FIG. 1, the marine vessel 100 includes a hull 101 and the marine propulsion system 102 provided on or in the hull 101. The hull 101 may be a hull of a fishing boat or a fishing vessel for a user to fish, or a relatively large hull such as a passenger vessel, for example.

The marine propulsion system 102 includes a main propulsion device 1, an auxiliary propulsion device 2, a joystick 3, a display 4 that displays navigation-related information, etc., an orientation sensor 5*a*, a position sensor 5*b*, and a controller 6. The joystick 3, the display 4, the orientation sensor 5*a*, the position sensor 5*b*, and the controller 6 are mounted on or in the hull 101.

The marine propulsion system 102 (controller 6) performs a fixed point holding (Stay Point™) control to maintain the orientation T1 (FWD) of a bow 101*a* of the hull 101 at a target orientation T2 (see FIG. 7) and maintain the position A1 of the hull 101 at a target point A2 (see FIG. 7) by causing the main propulsion device 1 and the auxiliary propulsion device 2 to cooperate with each other. In the fixed point holding control, without the user maneuvering the marine vessel, the orientation of the hull 101 is automatically maintained at the target orientation T2 specified by the user, and the position of the hull 101 is automatically maintained at the target point A2 specified by the user. The fixed point holding control is described below in detail.

The "cooperate" described above refers to automatically driving the main propulsion device 1 and the auxiliary propulsion device 2 at the same time to adjust mutual rudder angles (orientations) and mutual outputs of the main propulsion device 1 and the auxiliary propulsion device 2 in the fixed point holding (Stay Point™) control.

Figure 2:
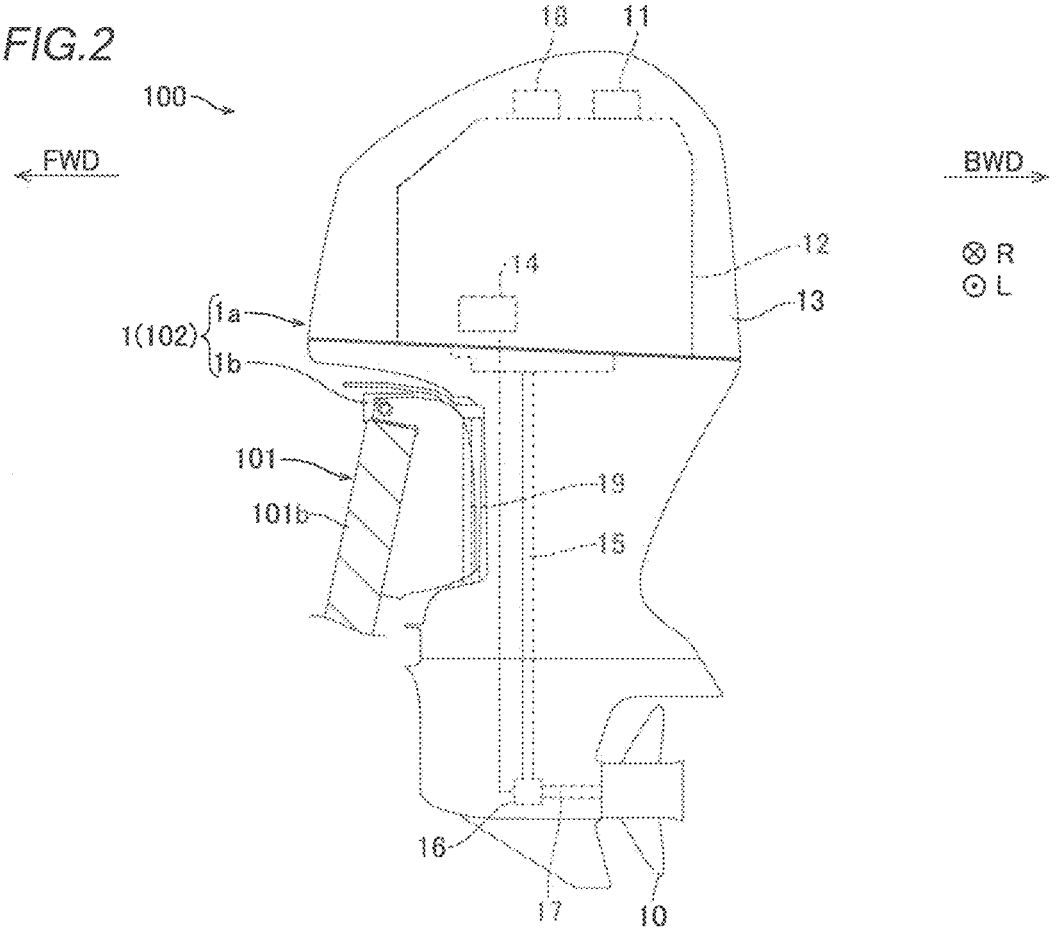
FIG. 2 is a side view showing a main propulsion device of a marine propulsion system according to a preferred embodiment of the present invention.
Figure 4:
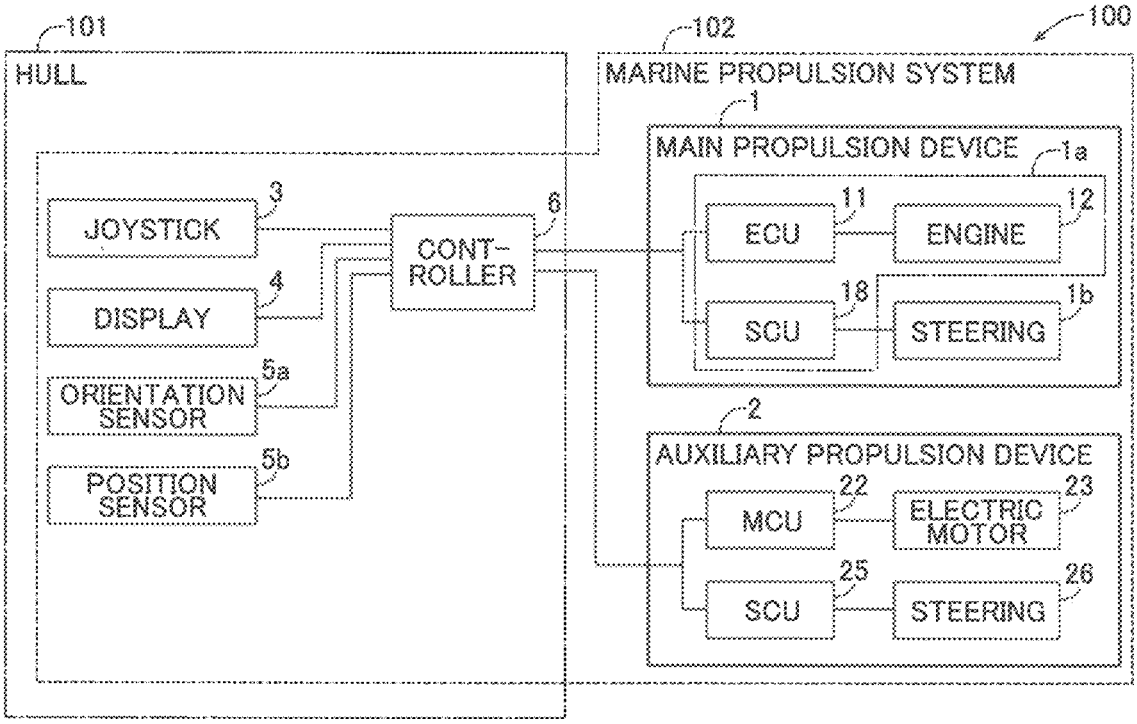
FIG. 4 is a block diagram of a marine vessel including a marine propulsion system and a hull according to a preferred embodiment of the present invention.

Only one main propulsion device 1 shown in FIGS. 2 and 4 is attached to the stern 101*b* (transom) of the hull 101. The main propulsion device 1 is an engine outboard motor including an engine 12 to drive a main propeller 10 to generate a thrust. The main propulsion device 1 is provided on a centerline α of the hull 101 in the right-left direction. The main propulsion device 1 rotates in the right-left direction to change the direction of the thrust of the main propeller 10. The main propeller 10 is an example of a "main thruster".

The main propulsion device 1 includes a main propulsion device body 1*a* and a steering mechanism 1*b* provided on the main propulsion device body 1*a*. The main propulsion device body 1*a* is attached to the stern 101*b* of the hull 101 via the steering mechanism 1*b*.

The main propulsion device body 1*a* includes the main propeller 10, an engine control unit (ECU) 11, the engine 12, a cowling 13, a shift actuator 14, a drive shaft 15, a gearing 16, a propeller shaft 17, and a steering control unit (SCU) 18.

The ECU 11 is a control circuit, for example, and includes a central processing unit (CPU). The ECU 11 controls driving of the engine 12 based on a command from the controller 6.

The engine 12 is a drive source for the main propeller 10. The engine 12 is provided in an upper portion of the main propulsion device 1, and is an internal combustion engine driven by explosive combustion of gasoline, light oil, or the like. The engine 12 is covered with the cowling 13. As an example, the maximum output P10 (see FIG. 5) of the engine 12 is about 200 horsepower.

The shift actuator 14 switches the shift state of the main propulsion device 1 to any one of a forward movement state (shift F), a reverse movement state (shift R), and a neutral state (shift N) by switching the meshing of the gearing 16. When the shift state of the main propulsion device 1 is in the forward movement state, a thrust is generated from the main propeller 10 toward the FWD side, and when the shift state is in the reverse movement state, a thrust is generated from the main propeller 10 toward the BWD side. When the shift state is in the neutral state, a thrust is not generated from the main propeller 10.

When the shift state is switched, the meshing state of the gearing 16 of the main propulsion device 1 is changed, and thus a shift shock occurs in the gearing 16. That is, when the shift state is switched, the gearing 16 of the main propulsion device 1 generates relatively loud noise and vibrations.

The drive shaft 15 is connected to a crankshaft (not shown) of the engine 12 so as to transmit a power from the engine 12. The drive shaft 15 extends directly below the engine 12 with the main propeller 10 located in the water.

The gearing 16 transmits a rotational force from the drive shaft 15 to the propeller shaft 17. The main propeller 10 is attached to a rear end of the propeller shaft 17. The main propeller 10 generates a thrust in the axial direction of the propeller shaft 17 by rotating in the water. The main propeller 10 moves the hull 101 forward or rearward by switching the direction of a thrust between a forward direction and a rearward direction according to the rotational direction switched depending on the shift state.

The SCU 18 is a control circuit, for example, and includes a central processing unit (CPU). The SCU 18 controls driving of the steering mechanism 1*b* based on a command from the controller 6.

The steering mechanism 1*b* rotates the main propulsion device body 1*a* in the right-left direction with a steering shaft 19 extending in an upward-downward direction as a central axis of rotation. That is, the steering mechanism 1*b* changes the orientation of the main propulsion device body 1*a* in the right-left direction. When the orientation of the main propulsion device body 1*a* in the right-left direction changes, the direction of the thrust of the main propeller 10 also changes according to the orientation of the main propulsion device body 1*a*.

As an example, a right-left rotatable angle range θ1 (see FIG. 1) to change the direction of the thrust of the main propulsion device 1 is about 60 degrees (30 degrees on one side). As an example, the steering mechanism 1*b* includes a hydraulic cylinder (not shown) to apply a rotational force to the steering shaft 19, an electric pump (not shown) to pressure-feed oil to drive the hydraulic cylinder, etc.

Figure 3:
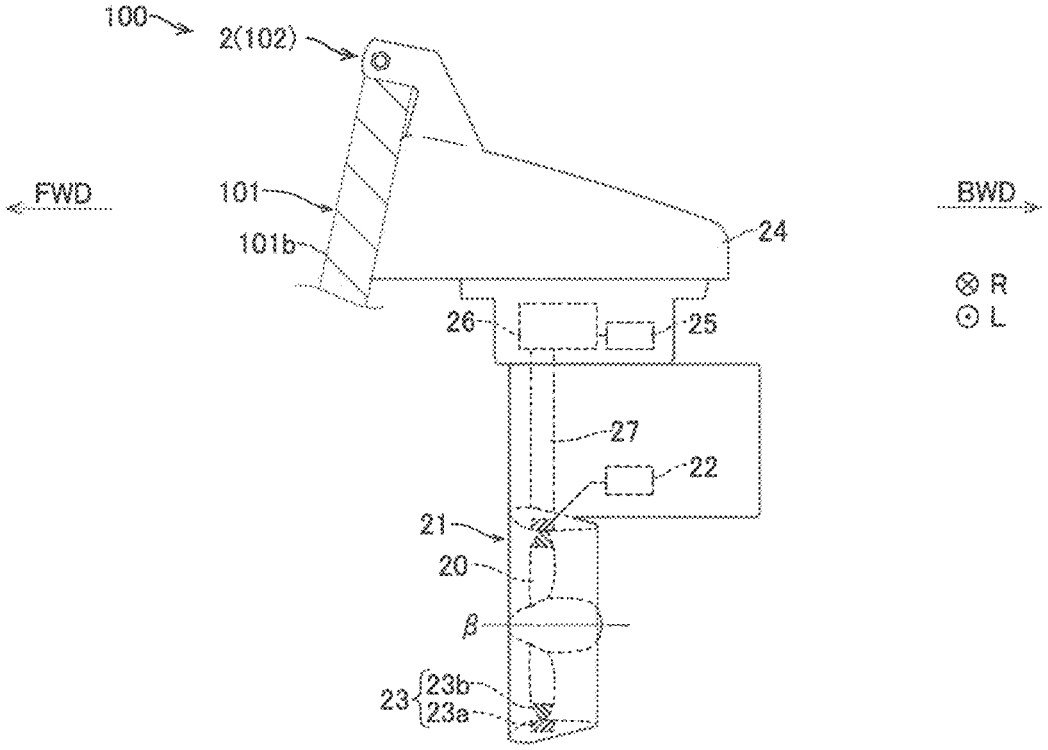
FIG. 3 is a side view showing an auxiliary propulsion device of a marine propulsion system according to a preferred embodiment of the present invention.

Only one auxiliary propulsion device 2 shown in FIGS. 3 and 4 is attached to the stern 101*b* (transom) of the hull 101. The auxiliary propulsion device 2 is an electric outboard motor including an electric motor 23 to drive an auxiliary propeller 20 to generate a thrust. The auxiliary propulsion device 2 is provided to one side of the centerline of the hull 101 in the right-left direction. Specifically, the auxiliary propulsion device 2 is located on the left side relative to the centerline a (see FIG. 1) of the hull 101 in the right-left direction. The auxiliary propulsion device 2 rotates in the right-left direction to change the direction of the thrust of the auxiliary propeller 20. The auxiliary propeller 20 is an example of an "auxiliary thruster".

The auxiliary propulsion device 2 includes the auxiliary propeller 20, a duct 21, a motor control unit (MCU) 22, the electric motor 23, a cowling 24, a steering control unit (SCU) 25, and a steering mechanism 26.

The duct 21 is provided in a lower portion of the auxiliary propulsion device 2 with the auxiliary propeller 20 located in the water. The duct 21 has a cylindrical shape and supports the auxiliary propeller 20 on the inner peripheral side such that the auxiliary propeller 20 is rotatable. In FIG. 3, the central position of rotation of the auxiliary propeller 20 is indicated by a central axis β. That is, the auxiliary propeller 20 generates a thrust in a direction along the central axis β.

The MCU 22 is a control circuit, for example, and includes a central processing unit (CPU). The MCU 22 controls driving of the electric motor 23 based on a command from the controller 6.

The electric motor 23 is a drive source for the auxiliary propeller 20. The electric motor 23 is driven by power from a battery (not shown) mounted in the hull 101, for example. The maximum output P20 of the electric motor 23 of the auxiliary propulsion device 2 is smaller than the maximum output P10 of the engine 12 of the main propulsion device 1. As an example, the maximum output P20 (see FIG. 5) of the electric motor 23 is about 20 horsepower.

The electric motor 23 includes a stator 23*a* integral and unitary with the duct 21 and a rotor 23*b* integral and unitary with the auxiliary propeller 20.

The cowling 24 covers an upper portion of the auxiliary propulsion device 2 such that electrical wiring and the like are not exposed. The cowling 24 does not rotate in the right-left direction unlike the auxiliary propeller 20 when the direction of the thrust in the right-left direction is changed. That is, the auxiliary propulsion device 2 does not rotate the entire auxiliary propulsion device 2 (auxiliary propulsion device body) excluding the steering mechanism 26 in the right-left direction but rotates only a portion (such as the duct 21 and the auxiliary propeller 20) of the auxiliary propulsion device 2 on the lower side, unlike the main propulsion device 1 that rotates the entire main propulsion device body 1*a* excluding the steering mechanism 1*b* in the right-left direction.

Therefore, the auxiliary propulsion device 2 does not need to rotate a relatively large structure such as the engine 12 of the main propulsion device 1 in the right-left direction, and thus a right-left rotatable angle range θ2 (see FIG. 1) to change the direction of the thrust is relatively large. As an example, the right-left rotatable angle range θ2 to change the direction of the thrust of the auxiliary propulsion device 2 is about 140 degrees (70 degrees on one side).

The auxiliary propeller 20 generates a thrust by rotating in the water. The drive source for the auxiliary propeller 20 is the electric motor 23, and thus the auxiliary propeller 20 is able to freely switch between forward rotation, reverse rotation (the direction of the thrust in the forward-rearward direction), and stop without generating a shift shock unlike the main propulsion device 1.

The SCU 25 is a control circuit, for example, and includes a central processing unit (CPU). The SCU 25 controls driving of the steering mechanism 26 based on a command from the controller 6.

The steering mechanism 26 is built into the auxiliary propulsion device 2. The steering mechanism 26 rotates the duct 21 in the right-left direction with a steering shaft 27 extending in the upward-downward direction as a central axis of rotation. When the orientation of the duct 21 in the right-left direction changes, the direction of the thrust of the auxiliary propeller 20 supported by the duct 21 also changes.

As an example, the steering mechanism 26 includes a reduction gear unit (not shown) to apply a rotational force to the steering shaft 27, an electric motor (not shown) to drive the reduction gear unit, etc.

The power range P1 of the engine 12 of the main propulsion device 1 and the power range P2 of the electric motor 23 of the auxiliary propulsion device 2 are now described with reference to FIG. 5.

The maximum and minimum values of the power range P1 of the engine 12 that drives the main propeller 10 are both larger than those of the electric motor 23 that drives the auxiliary propeller 20. Specifically, the maximum value (maximum output P10) of the power range P1 of the engine 12 is larger than the maximum value (maximum output P20) of the power range P2 of the electric motor 23. The minimum value (minimum output P11) of the power range P1 of the engine 12 is larger than the minimum value (minimum output P21) of the power range P2 of the electric motor 23.

The upper limit value of the power range P1 of the engine 12 is limited when the main propulsion device 1 and the auxiliary propulsion device 2 are caused to cooperate with each other in the fixed point holding (Stay Point™) control. The lower limit value of the power range P2 of the electric motor 23 is limited when the main propulsion device 1 and the auxiliary propulsion device 2 are caused to cooperate with each other in the fixed point holding control. The details are described below.

Figure 6:
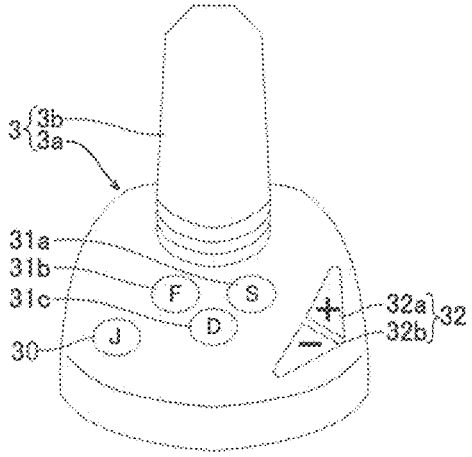
FIG. 6 is a diagram showing a joystick of a marine propulsion system according to a preferred embodiment of the present invention.

The joystick 3 shown in FIG. 6 is an operator to maneuver the marine vessel. The joystick 3 includes a main body 3*a* and a columnar stick 3*b* extending upward from the main body 3*a*. The stick 3*b* is a portion that is gripped by the user during maneuvering of the marine vessel.

The main body 3*a* includes a joystick button 30, three buttons to start an automatic marine vessel maneuvering mode including a Stay Point™ button 31*a*, a Fish Point™ button 31*b*, and a drift button 31*c*, and a thrust adjustment operation button 32.

The joystick button 30 receives operations to start and end a joystick mode. That is, the joystick button 30 switches between a normal state and a state (joystick mode) in which the joystick 3 is used to maneuver the marine vessel. In the normal state, the marine vessel is maneuvered using a remote control lever (not shown) to switch the shift state and adjust the engine speed, for example, and a steering wheel (not shown) to operate steering.

The Stay Point™ button 31*a* receives operations to start and end the Stay Point™ (fixed point holding) control. The Stay Point™ (fixed point holding) control refers to an automatic marine vessel maneuvering control to maintain the orientation T1 of the bow 101*a* of the hull 101 at the target orientation T2 and maintain the position A1 of the hull 101 at the target point A2.

The Fish Point™ button 31*b* receives operations to start and end a Fish Point™ control. The Fish Point™ control refers to an automatic marine vessel maneuvering control to direct the stern 101*b* (or the bow 101*a*) of the hull 101 to the target point by rotating the hull 101 and maintain the hull 101, the stern 101*b* (or the bow 101*a*) of which has been directed to the target point, at the target point by moving the hull 101 in the forward-rearward direction. The hull 101 does not move laterally in the Fish Point™ control.

The drift button 31*c* receives operations to start and end a drift control. The drift control refers to an automatic marine vessel maneuvering control to move the hull 101 by receiving external forces including wind and water flow while maintaining the orientation of the bow 101*a* of the hull 101 at the target orientation by rotating the hull 101.

The thrust adjustment operation button 32 receives an operation to adjust the level of the thrust magnitude of the marine vessel 100 (the main propulsion device 1 and the auxiliary propulsion device 2). The thrust adjustment operation button 32 includes a plus button 32*a* to increase the level of the thrust magnitude and a minus button 32*b* to decrease the level of the thrust magnitude.

In the joystick mode, the marine vessel 100 moves in the tilting direction of the stick 3*b* while maintaining the orientation T1 of the bow 101*a* based on a tilting operation of the stick 3*b* by the user. In such a case, the orientations of the bow 101*a* before and after the movement are parallel or substantially parallel to each other. Predetermined calibration is performed in advance on the marine vessel 100 (controller 6) by a boat builder or the like such that the tilting direction of the stick 3*b* matches the actual moving direction of the hull 101.

In the joystick mode, the marine vessel 100 rotates in the twisting direction of the stick 3*b* based on a twisting operation of the stick 3*b* by the user.

In the joystick mode, the marine vessel 100 turns in the tilting and twisting directions of the stick 3*b* based on simultaneous tilting and twisting operations of the stick 3*b* by the user. The term "turn" indicates moving the hull 101 in the tilting direction of the stick 3*b* while gradually changing the orientation T1 of the bow 101*a* in the twisting direction of the stick 3*b*.

In the fixed point holding control, automatic marine vessel maneuvering is performed, and thus the stick 3*b* is not operated by the user. Furthermore, in the fixed point holding control, the marine vessel 100 only moves and rotates while maintaining the orientation T1 of the bow 101*a*, and does not turn.

Figure 7:
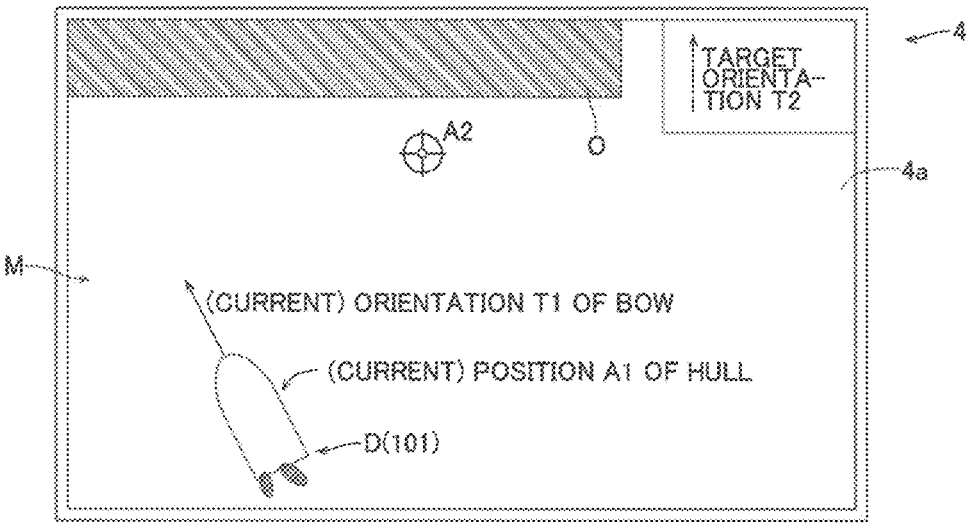
FIG. 7 is a diagram showing a display example for a fixed point holding control of a display of a marine propulsion system according to a preferred embodiment of the present invention.

As shown in FIG. 7, the display 4 includes a touch panel 4*a*. As an example, when the Stay Point™ button 31*a* (see FIG. 6) is operated to start the Stay Point™ control, the display 4 displays a simplified model D of the hull 101 and a surrounding map M around the hull 101 including an obstacle O around the hull 101.

The display 4 receives the setting of the target orientation T2 and the target point A2 based on a user's touch operation on the touch panel 4*a*. The setting of the target orientation T2 and the target point A2 may be performed via another operator such as a panel operator (not shown). The display 4 displays the target orientation T2 and the target point A2 set on the surrounding map M. Furthermore, the display 4 displays the current orientation T1 of the marine vessel 100 on the surrounding map M.

The orientation sensor 5*a* shown in FIG. 1 measures the current orientation T1 of the marine vessel 100, which is the orientation (FWD) of the bow 101*a* of the marine vessel 100. The orientation sensor 5*a* is used to determine whether or not the current orientation T1 of the marine vessel 100 deviates from the target orientation T2 in the fixed point holding control, for example. As an example, the orientation sensor 5*a* includes an electronic compass.

The position sensor 5*b* measures the current position A1 of the hull 101. The marine vessel 100 also acquires the current speed of the marine vessel 100 based on the time change of the current position A1 of the hull 101 measured by the position sensor 5*b*. As an example, the position sensor 5*b* includes a global positioning system (GPS) device.

The controller 6 is a control circuit, for example, and includes a central processing unit (CPU).

The controller 6 performs the fixed point holding (Stay Point™) control to maintain the orientation T1 of the bow 101*a* of the hull 101 at the target orientation T2 and maintain the position A1 of the hull 101 at the target point A2 by causing the main propulsion device 1 and the auxiliary propulsion device 2 to cooperate with each other.

Specifically, in the fixed point holding control, the controller 6 corrects a deviation of the current orientation T1 of the bow 101*a* of the hull 101 from the target orientation T2 by rotating the hull 101 (brings the amount of deviation of the orientation closer to 0 by rotating the hull 101). The controller 6 calculates the amount of deviation of the orientation T1 of the bow 101*a* based on the measurement value of the orientation sensor 5*a*.

In the fixed point holding control, the controller 6 corrects a deviation of the current position A1 of the hull 101 from the target point A2 by moving the hull 101 (brings the amount of deviation of the position closer to 0 by moving the hull 101). The controller 6 calculates the amount of deviation of the position based on the measurement value of the position sensor 5*b*. The term "move" in the fixed point holding control indicates changing the position A1 of the hull 101 while maintaining the orientation T1 of the bow 101*a* of the hull 101.

In the fixed point holding control, the controller 6 performs a control to rotate the hull 101 to maintain the orientation T1 of the bow 101*a* at the target orientation T2 and a control to move the hull 101 to maintain the position A1 of the hull 101 at the target point A2 at different timings.

Figure 5:
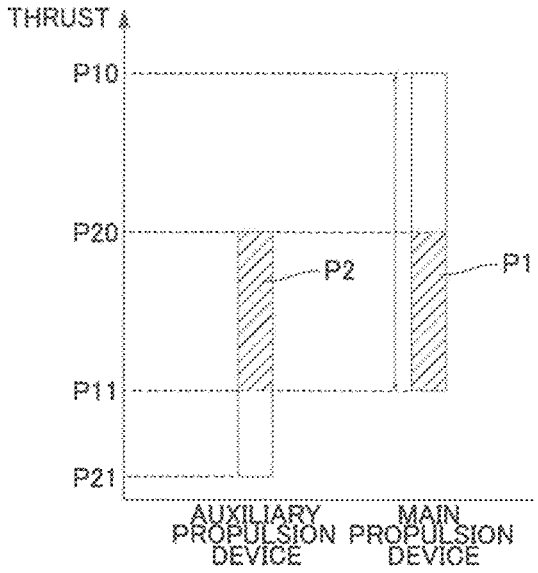
FIG. 5 is a diagram illustrating the power range of an engine of a main propulsion device and the power range of an electric motor of an auxiliary propulsion device according to a preferred embodiment of the present invention.

The controller 6 limits the power range P1 of the engine 12 by matching the upper limit value of the power range P1 of the engine 12 with the maximum value (maximum output P20) of the power range P2 of the electric motor 23 while the main propulsion device 1 and the auxiliary propulsion device 2 are caused to cooperate with each other to move the hull 101 (see FIG. 5). Furthermore, the controller 6 limits the power range P2 of the electric motor 23 by matching the lower limit value of the power range P2 of the electric motor 23 with the minimum value (minimum output P11) of the power range P1 of the engine 12 while the main propulsion device 1 and the auxiliary propulsion device 2 are caused to cooperate with each other to move the hull 101 (see FIG. 5).

That is, the controller 6 sets a common power range for the engine 12 and the electric motor 23, in which the upper limit values of the outputs are the same as each other and the lower limit values of the outputs are the same as each other while the main propulsion device 1 and the auxiliary propulsion device 2 are caused to cooperate with each other to move the hull 101 (see FIG. 5).

Figure 8:
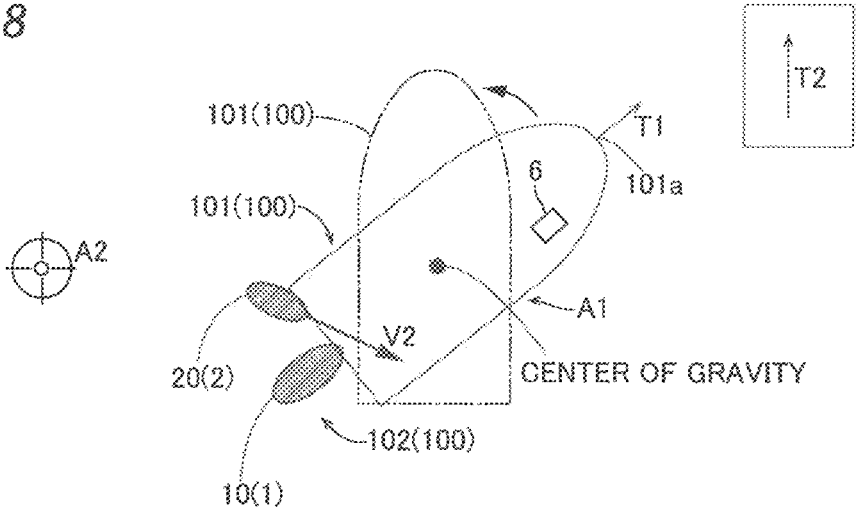
FIG. 8 is a diagram illustrating a control to rotate a hull by a controller of a marine propulsion system according to a preferred embodiment of the present invention.

As shown in FIG. 8, the controller 6 rotates the hull 101 by driving the auxiliary propeller 20 to generate a thrust from the auxiliary propulsion device 2 while the main propeller 10 that generates a thrust from the main propulsion device 1 is stopped when the hull 101 is rotated to maintain the orientation T1 of the bow 101*a* at the target orientation T2 in the fixed point holding control.

In such a case, the controller 6 rotates the hull 101 about the center of gravity of the hull 101 on the spot while holding the position A1 of the hull 101 in the fixed point holding control. Such a so-called "pivot turning" is not able to be provided with the main propulsion device 1 (engine outboard motor) having a relatively small right-left rotatable angle range θ1 (see FIG. 1) to change the direction of the thrust.

Figure 9:
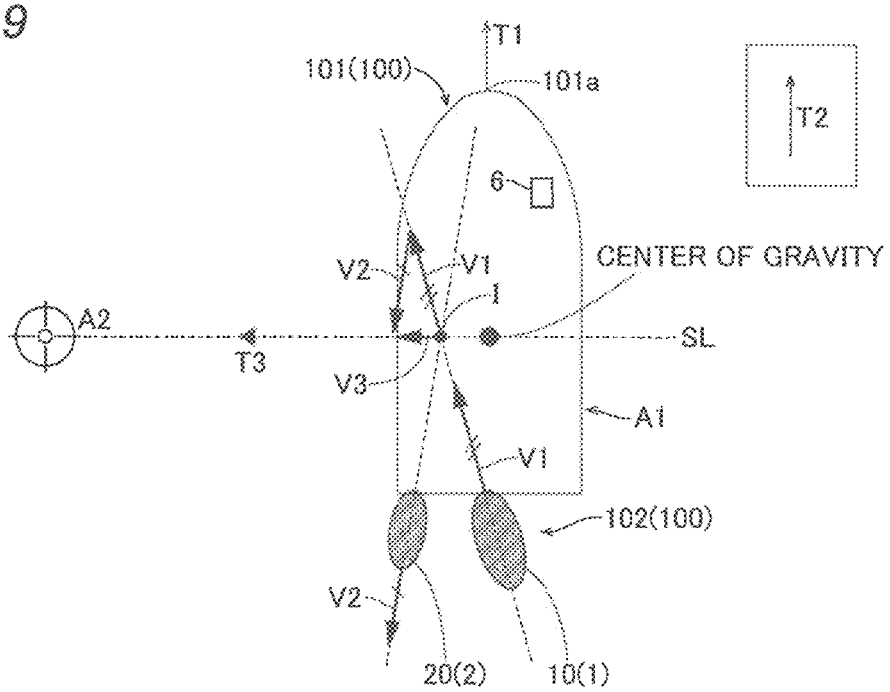
FIG. 9 is a diagram illustrating a control to move a hull laterally and diagonally by a controller of a marine propulsion system according to a preferred embodiment of the present invention.
Figure 10:
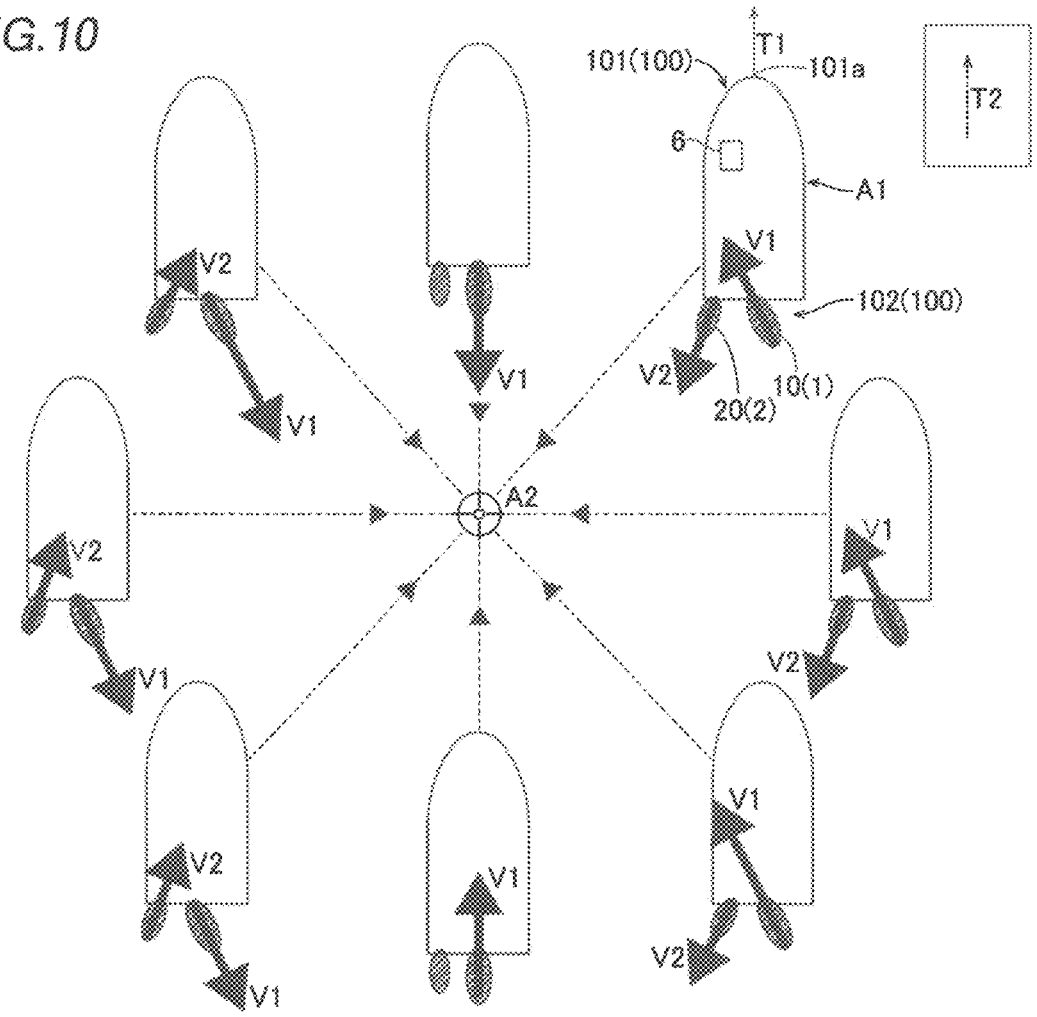
FIG. 10 is a diagram illustrating the relationship between the direction of the output vector of a main propeller and the direction of the output vector of an auxiliary propeller during lateral movement and diagonal movement of a hull according to a preferred embodiment of the present invention.

As shown in FIGS. 9 and 10, the controller 6 moves the hull 101 in the forward-rearward direction by driving the main propeller 10 while the auxiliary propeller 20 is stopped when the hull 101 is moved to maintain the position A1 of the hull 101 at the target point A2 in the fixed point holding control.

The controller 6 moves the hull 101 laterally and diagonally while maintaining the orientation T1 of the bow 101*a* by simultaneously driving the main propeller 10 that generates a thrust from the main propulsion device 1 and the auxiliary propeller 20 that generates a thrust from the auxiliary propulsion device 2 when the hull 101 is moved to maintain the position A1 of the hull 101 at the target point A2 in the fixed point holding control.

In such a case, the controller 6 moves the hull 101 laterally and diagonally while maintaining the orientation T1 of the bow 101*a* by positioning an intersection I of the output vector V1 of the main propeller 10 and the output vector V2 of the auxiliary propeller 20 on a straight line SL extending through the center of gravity of the hull 101 and the target point A2 and setting, in a direction from the center of gravity to the target point A2, the direction T3 of the resultant force V3 of the output vector V1 of the main propeller 10 and the output vector V2 of the auxiliary propeller 20 that indicates the moving direction of the hull 101.

The controller 6 causes the direction of the output vector V1 of the main propeller 10 and the direction of the output vector V2 of the auxiliary propeller 20 to be opposite to each other in the forward-rearward direction when the hull 101 is moved laterally or diagonally while the orientation T1 of the bow 101*a* is maintained.

Figure 11:
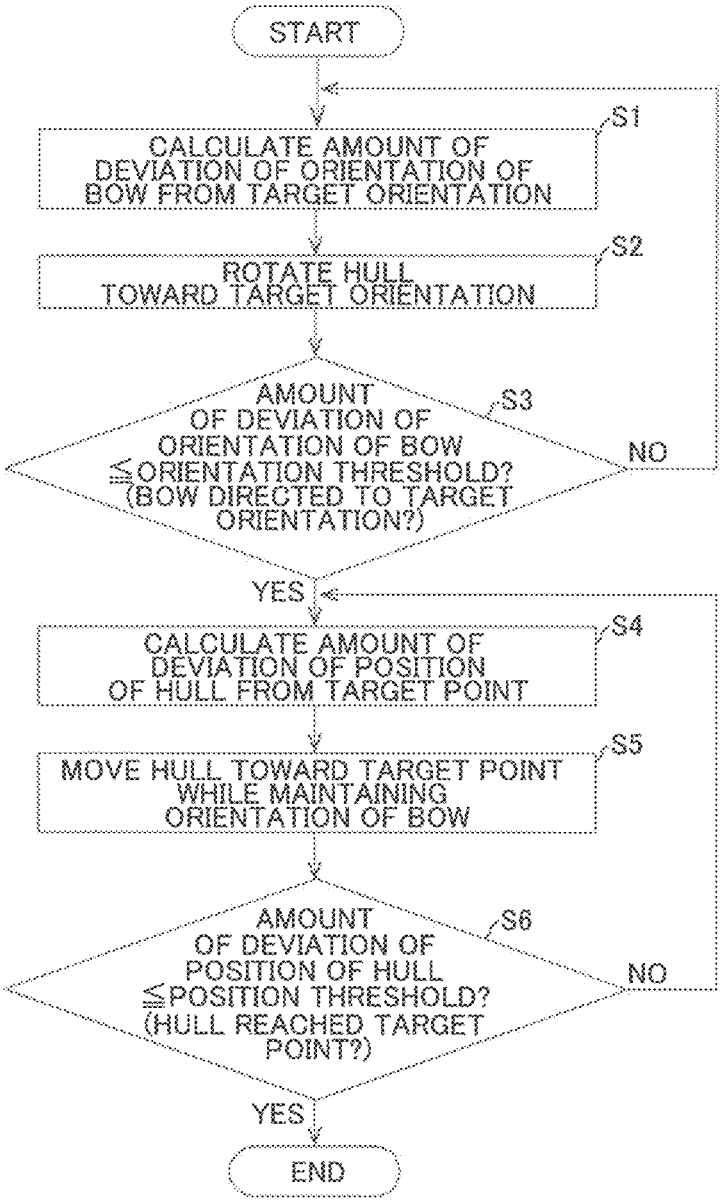
FIG. 11 is a flowchart of a control process for fixed point holding executed by a controller of a marine propulsion system according to a preferred embodiment of the present invention.

A fixed point holding control process by the controller 6 of the marine propulsion system 102 is now described with reference to FIG. 11. In a flowchart shown in FIG. 11, it is assumed that the control process starts from a state in which the amount of deviation of the current orientation T1 of the bow 101*a* from the target orientation T2 exceeds an orientation threshold and the amount of deviation of the current position A1 of the hull 101 from the target point A2 exceeds a position threshold. In short, the control process to correct the orientation T1 of the bow 101*a* relatively greatly deviated from the target orientation T2 and the position A1 of the hull 101 relatively greatly deviated from the target point A2 is described below.

In step S1, the amount of deviation of the orientation T1 of the bow 101*a* from the target orientation T2 is calculated based on the measurement value of the orientation sensor 5*a*. Then, the process advances to step S2.

In step S2, the hull 101 is rotated by driving the auxiliary propeller 20 while the main propeller 10 is stopped. Then, the process advances to step S3.

In step S3, it is determined whether or not the amount of deviation of the orientation T1 of the bow 101*a* is equal to or less than the orientation threshold. When the amount of deviation of the orientation T1 of the bow 101*a* is equal to or less than the orientation threshold, the orientation T1 of the bow 101*a* substantially matches the target orientation T2. In step S3, when the amount of deviation of the orientation T1 of the bow 101*a* is equal to or less than the orientation threshold, the process advances to step S4, and when the amount of deviation of the orientation T1 of the bow 101*a* is not equal to or less than the orientation threshold, the process returns to step S1.

In step S4, the amount of deviation of the position A1 of the hull 101 from the target point A2 is calculated based on the measurement value of the position sensor 5*b*. Then, the process advances to step S5.

In step S5, the hull 101 is moved toward the target point A2 while the orientation T1 of the bow 101*a* is maintained. At this time, when the hull 101 is moved in the forward-rearward direction, the hull 101 is moved by driving the main propeller 10 while the auxiliary propeller 20 is stopped. When the hull 101 is moved diagonally or laterally, the hull 101 is moved by simultaneously driving the auxiliary propeller 20 and the main propeller 10. Then, the process advances to step S6.

In step S6, it is determined whether or not the amount of deviation of the position A1 of the hull 101 is equal to or less than the position threshold. When the amount of deviation of the position A1 of the hull 101 is equal to or less than the position threshold, the position A1 of the hull 101 substantially matches the target point A2. In step S6, when the amount of deviation of the position A1 of the hull 101 is equal to or less than the position threshold, the process proceeds to END, and when the amount of deviation of the position A1 of the hull 101 is not equal to or less than the position threshold, the process returns to step S4.

According to the various preferred embodiments of the present invention described above, the following advantageous effects are achieved.

According to a preferred embodiment of the present invention, the marine propulsion system 102 includes the controller 6 configured or programmed to perform the fixed point holding (Stay Point™) control to maintain the orientation T1 of the bow 101*a* of the hull 101 at the target orientation T2 and maintain the position A1 of the hull 101 at the target point A2 by causing the main propulsion device 1 and the auxiliary propulsion device 2 to cooperate with each other. Accordingly, unlike a case in which only the auxiliary propulsion device is driven in the fixed point holding control, the main propulsion device 1 and the auxiliary propulsion device 2 are caused to cooperate with each other to flexibly rotate and move the hull 101 so as to maintain the orientation T1 of the bow 101*a* of the hull 101 at the target orientation T2 and maintain the position A1 of the hull 101 at the target point A2. Furthermore, the auxiliary propulsion device 2 includes the electric motor 23 to drive the auxiliary propeller 20 to generate a thrust. Accordingly, as compared with a case in which the main propulsion device 1 is driven and the auxiliary propulsion device 2 is an engine propulsion device, the amount of carbon dioxide emitted from the auxiliary propulsion device 2 is reduced. Thus, the hull 101 including the main propulsion device 1 and the auxiliary propulsion device 2 is held at a fixed point while environmental burdens associated with driving of the auxiliary propulsion device 2 are reduced or minimized.

According to a preferred embodiment of the present invention, the main propulsion device 1 is provided on the centerline α of the hull 101 in the right-left direction, and the auxiliary propulsion device 2 is provided to one side of the centerline of the hull 101 in the right-left direction. Accordingly, in the marine vessel 100 including the main propulsion device 1 provided on the centerline α of the hull 101 in the right-left direction, and the auxiliary propulsion device 2 provided to one side of the centerline of the hull 101 in the right-left direction, the main propulsion device 1 and the auxiliary propulsion device 2 are caused to cooperate with each other to flexibly rotate and move the hull 101, and thus the directions and magnitudes of the thrusts of the main propulsion device 1 and the auxiliary propulsion device 2 are adjusted in the fixed point holding control.

According to a preferred embodiment of the present invention, the auxiliary propulsion device 2 has the right-left rotatable angle range θ2 to change the direction of the thrust larger than the right-left rotatable angle range θ1 of the main propulsion device 1, and the controller 6 is configured or programmed to rotate the hull 101 by driving the auxiliary propulsion device 2 in the fixed point holding control. Accordingly, the hull 101 is rotated (pivot-turned) by the electric motor-driven (electric) auxiliary propulsion device 2 that has the right-left rotatable angle range θ2 to change the direction of the thrust larger than the right-left rotatable angle range θ1 of the main propulsion device 1 such that a change in the position A1 of the hull 101 becomes smaller.

According to a preferred embodiment of the present invention, the main propulsion device 1 includes the engine 12 to drive the main propeller 10 to generate a thrust, and the engine 12 has the maximum value and the minimum value of the power range P1 larger than the maximum value and the minimum value of the power range of the electric motor 23. The controller 6 is configured or programmed to limit the power range P1 of the engine 12 by matching the upper limit value of the power range P1 of the engine 12 with the maximum value of the power range P2 of the electric motor 23 while the main propulsion device 1 and the auxiliary propulsion device 2 are caused to cooperate with each other to move the hull 101, and to limit the power range P2 of the electric motor 23 by matching the lower limit value of the power range P2 of the electric motor 23 with the minimum value of the power range P1 of the engine 12 while the main propulsion device 1 and the auxiliary propulsion device 2 are caused to cooperate with each other to move the hull 101. Accordingly, the power range P1 of the engine 12 and the power range P2 of the electric motor 23 are adjusted to be equivalent or substantially equivalent to each other, and thus when the main propulsion device 1 and the auxiliary propulsion device 2 are caused to cooperate with each other, the output of the engine 12 and the output of the electric motor 23 are prevented from being out of balance.

According to a preferred embodiment of the present invention, the controller 6 is configured or programmed to rotate the hull 101 by driving the auxiliary propeller 20 to generate a thrust from the auxiliary propulsion device 2 while the main propeller 10 that generates a thrust from the main propulsion device 1 is stopped when the hull 101 is rotated to maintain the orientation T1 of the bow 101*a* at the target orientation T2 in the fixed point holding control. Accordingly, the hull 101 is rotated only by the electric auxiliary propulsion device 2, and thus the hull 101 is quietly rotated. Furthermore, a thrust is generated only from the electric motor-driven (electric) auxiliary propulsion device 2 during rotation of the hull 101, and thus environmental burdens during rotation of the hull 101 are reduced.

According to a preferred embodiment of the present invention, the controller 6 is configured or programmed to rotate the hull 101 about the center of gravity of the hull 101 on the spot while holding the position A1 of the hull 101. Accordingly, the hull 101 is rotated on the spot without changing the position A1 of the hull 101, and thus the accuracy of maintaining the target point A2 in the fixed point holding control is improved.

According to a preferred embodiment of the present invention, the controller 6 is configured or programmed to, when the hull 101 is moved to maintain the position A1 of the hull 101 at the target point A2 in the fixed point holding control, move the hull 101 laterally or diagonally while maintaining the orientation T1 of the bow 101*a* by simultaneously driving the main propeller 10 to generate a thrust from the main propulsion device 1 and the auxiliary propeller 20 to generate a thrust from the auxiliary propulsion device 2, and move the hull 101 in the forward-rearward direction by driving the main propeller 10 while the auxiliary propeller 20 is stopped. Accordingly, the main propeller 10 and the auxiliary propeller 20 are simultaneously driven (caused to cooperate with each other) such that the hull 101 is moved laterally or diagonally while the orientation T1 of the bow 101*a* is maintained, and the hull 101 is moved in the forward-rearward direction by driving only the main propeller 10.

According to a preferred embodiment of the present invention, the controller 6 is configured or programmed to move the hull 101 laterally or diagonally while maintaining the orientation T1 of the bow 101*a* by positioning the intersection I of the output vector V1 of the main propeller 10 and the output vector V2 of the auxiliary propeller 20 on the straight line SL extending through the center of gravity of the hull 101 and the target point A2 and setting, in the direction from the center of gravity to the target point A2, the direction T3 of the resultant force V3 of the output vector V1 of the main propeller 10 and the output vector V2 of the auxiliary propeller 20 that indicates the moving direction of the hull 101. Accordingly, even when the main propulsion device 1 and the auxiliary propulsion device 2 are not provided in a well-balanced manner with respect to the centerline α of the hull 101 in the right-left direction, the hull 101 is moved laterally or diagonally while the orientation T1 of the bow 101*a* is maintained.

According to a preferred embodiment of the present invention, the controller 6 is configured or programmed to cause the direction of the output vector V1 of the main propeller 10 and the direction of the output vector V2 of the auxiliary propeller 20 to be opposite to each other in the forward-rearward direction when the hull 101 is moved laterally or diagonally while the orientation T1 of the bow 101*a* is maintained. Accordingly, the direction of the output vector V1 of the main propeller 10 and the direction of the output vector V2 of the auxiliary propeller 20 are opposite to each other, and thus the hull 101 is easily moved laterally or diagonally while the orientation T1 of the bow 101*a* is maintained.

According to a preferred embodiment of the present invention, the controller 6 is configured or programmed to perform a control to rotate the hull 101 to maintain the orientation T1 of the bow 101*a* at the target orientation T2 and a control to move the hull 101 to maintain the position A1 of the hull 101 at the target point A2 at the different timings in the fixed point holding control. Accordingly, rotating the hull 100 to maintain the orientation T1 of the bow 101*a* at the target orientation T2 and moving the hull 101 to maintain the position A1 of the hull 101 at the target point A2 are separated from each other such that a change in the position A1 of the hull 101 during rotation of the hull 101 is reduced or prevented, and a change in the orientation T1 of the bow 101*a* during movement of the hull 101 is reduced or prevented.

According to a preferred embodiment of the present invention, the main propulsion device 1 is an engine outboard motor including the engine 12 to drive the main propeller to generate a thrust and provided on the centerline α of the hull 101 in the right-left direction, and the auxiliary propulsion device 2 is an electric outboard motor including the electric motor 23 to drive the auxiliary propeller 20 and provided to one side of the centerline of the hull 101 in the right-left direction. Accordingly, environmental burdens are reduced due to driving of the electric outboard motor, and the hull 101 including the engine outboard motor and the electric outboard motor is held at a fixed point.

The preferred embodiments of the present invention described above are illustrative in all points and not restrictive. The extent of the present invention is not defined by the above description of the preferred embodiments but by the scope of the claims, and all modifications within the meaning and range equivalent or substantially equivalent to the scope of the claims are further included.

For example, while the process operations performed by the controller are described using a flowchart in a flow-driven manner in which processes are performed in order along a process flow for the convenience of illustration in preferred embodiments described above, the present invention is not restricted to this. In the present invention, the process operations performed by the controller may alternatively be performed in an event-driven manner in which the processes are performed on an event basis. In this case, the process operations performed by the controller may be performed in a complete event-driven manner or in a combination of an event-driven manner and a flow-driven manner.

While the marine propulsion system preferably includes only one main propulsion device in preferred embodiments described above, the present invention is not restricted to this. In the present invention, the marine propulsion system may alternatively include a plurality of main propulsion devices.

While the marine propulsion system preferably includes only one auxiliary propulsion device in preferred embodiments described above, the present invention is not restricted to this. In the present invention, the marine propulsion system may alternatively include a plurality of auxiliary propulsion devices.

While the main thruster of the main propulsion device is preferably the main propeller in preferred embodiments described above, the present invention is not restricted to this. In the present invention, the main thruster of the main propulsion device may alternatively be a jet that generates a thrust by jetting water.

While the auxiliary thruster of the auxiliary propulsion device is preferably the auxiliary propeller in preferred embodiments described above, the present invention is not restricted to this. In the present invention, the auxiliary thruster of the auxiliary propulsion device may alternatively be a jet that generates a thrust by jetting water.

While the main propulsion device is preferably provided on the centerline of the hull in the right-left direction in preferred embodiments described above, the present invention is not restricted to this. In the present invention, the main propulsion device may alternatively be shifted from the centerline of the hull in the right-left direction.

While the main propulsion device preferably includes the engine as a drive source for the main propeller in preferred embodiments described above, the present invention is not restricted to this. In the present invention, the main propulsion device may alternatively include an electric motor as a drive source for the main propeller.

While the main propulsion device and the auxiliary propulsion device are preferably outboard motors in preferred embodiments described above, the present invention is not restricted to this. In the present invention, the main propulsion device and the auxiliary propulsion device may alternatively be inboard-outboard motors, for example.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine propulsion system comprising:

a main propulsion device to be attached to a stern of a hull and operable to rotate in a right-left direction to change a direction of a thrust;

an auxiliary propulsion device to be attached to the stern, including an electric motor to drive an auxiliary thruster to generate a thrust, operable to rotate in the right-left direction to change a direction of the thrust, and having a maximum output smaller than a maximum output of the main propulsion device;

a controller configured or programmed to perform a fixed point holding control to maintain an orientation of a bow of the hull at a target orientation and maintain a position of the hull at a target point by causing the main propulsion device and the auxiliary propulsion device to cooperate with each other; and a display to display a surrounding map around the hull; wherein the display displays the target orientation and the target point when the controller performs the fixed point holding control.

2. The marine propulsion system according to claim 1, wherein the main propulsion device is provided on a centerline of the hull in the right-left direction; and the auxiliary propulsion device is provided to one side of the centerline of the hull in the right-left direction.

3. The marine propulsion system according to claim 1, wherein the auxiliary propulsion device has a right-left rotatable angle range to change the direction of the thrust larger than a right-left rotatable angle range of the main propulsion device; and the controller is configured or programmed to rotate the hull by driving the auxiliary propulsion device in the fixed point holding control.

4. The marine propulsion system according to claim 1, wherein the main propulsion device includes an engine to drive a main thruster to generate a thrust and having a maximum value and a minimum value of a power range larger than a maximum value and a minimum value of a power range of the electric motor; and the controller is configured or programmed to:

limit the power range of the engine by matching an upper limit value of the power range of the engine with the maximum value of the power range of the electric motor while the main propulsion device and the auxiliary propulsion device are caused to cooperate with each other to move the hull; and limit the power range of the electric motor by matching a lower limit value of the power range of the electric motor with the minimum value of the power range of the engine while the main propulsion device and the auxiliary propulsion device are caused to cooperate with each other to move the hull.

5. The marine propulsion system according to claim 1, wherein the controller is configured or programmed to rotate the hull by driving the auxiliary thruster to generate the thrust from the auxiliary propulsion device while a main thruster operable to generate a thrust from the main propulsion device is stopped when the hull is rotated to maintain the orientation of the bow at the target orientation in the fixed point holding control.

6. The marine propulsion system according to claim 5, wherein the controller is configured or programmed to rotate the hull about a center of gravity of the hull on the spot while holding the position of the hull.

7. The marine propulsion system according to claim 1, wherein the controller is configured or programmed to, when the hull is moved to maintain the position of the hull at the target point in the fixed point holding control, move the hull laterally or diagonally while maintaining the orientation of the bow by simultaneously driving a main thruster to generate the thrust from the main propulsion device and the auxiliary thruster to generate the thrust from the auxiliary propulsion device, and move the hull in a forward-rearward direction by driving the main thruster while the auxiliary thruster is stopped.

8. The marine propulsion system according to claim 7, wherein the controller is configured or programmed to move the hull laterally or diagonally while maintaining the orientation of the bow by positioning an intersection of an output vector of the main thruster and an output vector of the auxiliary thruster on a straight line extending through a center of gravity of the hull and the target point and setting, in a direction from the center of gravity to the target point, a direction of a resultant force of the output vector of the main thruster and the output vector of the auxiliary thruster that indicates a moving direction of the hull.

9. The marine propulsion system according to claim 7, wherein the controller is configured or programmed to cause a direction of an output vector of the main thruster and a direction of an output vector of the auxiliary thruster to be opposite to each other in the forward-rearward direction when the hull is moved laterally or diagonally while the orientation of the bow is maintained.

10. The marine propulsion system according to claim 1, wherein the controller is configured or programmed to perform a control to rotate the hull to maintain the orientation of the bow at the target orientation and a control to move the hull to maintain the position of the hull at the target point at different timings in the fixed point holding control.

11. The marine propulsion system according to claim 1, wherein the main propulsion device is an engine outboard motor including an engine to drive a main propeller to generate a thrust and provided on a centerline of the hull in the right-left direction; and the auxiliary propulsion device is an electric outboard motor including the electric motor to drive an auxiliary propeller corresponding to the auxiliary thruster and provided to one side of the centerline of the hull in the right-left direction.

12. A marine propulsion system comprising:

a main propulsion device to be attached to a stern of a hull and operable to rotate in a right-left direction to change a direction of a thrust;

an auxiliary propulsion device to be attached to the stern, operable to rotate in the right-left direction to change a direction of a thrust, and having a maximum output smaller than a maximum output of the main propulsion device;

a controller configured or programmed to perform a fixed point holding control to maintain an orientation of a bow of the hull at a target orientation and maintain a position of the hull at a target point by causing the main propulsion device and the auxiliary propulsion device to cooperate with each other; and a display to display a surrounding map around the hull; wherein the display displays the target orientation and the target point when the controller performs the fixed point holding control.

13. A marine vessel comprising:

a hull; and a marine propulsion system provided on or in the hull; wherein the marine propulsion system includes:

a main propulsion device attached to a stern of the hull and operable to rotate in a right-left direction to change a direction of a thrust;

an auxiliary propulsion device attached to the stern, including an electric motor to drive an auxiliary thruster to generate a thrust, operable to rotate in the right-left direction to change a direction of the thrust, and having a maximum output smaller than a maximum output of the main propulsion device;

a controller configured or programmed to perform a fixed point holding control to maintain an orientation of a bow of the hull at a target orientation and maintain a position of the hull at a target point by causing the main propulsion device and the auxiliary propulsion device to cooperate with each other; and a display to display a surrounding map around the hull; wherein the display displays the target orientation and the target point when the controller performs the fixed point holding control.

14. The marine vessel according to claim 13, wherein the main propulsion device is provided on a centerline of the hull in the right-left direction; and the auxiliary propulsion device is provided to one side of the centerline of the hull in the right-left direction.

15. The marine vessel according to claim 13, wherein the auxiliary propulsion device has a right-left rotatable angle range to change the direction of the thrust larger than a right-left rotatable angle range of the main propulsion device; and the controller is configured or programmed to rotate the hull by driving the auxiliary propulsion device in the fixed point holding control.

16. The marine vessel according to claim 13, wherein the main propulsion device includes an engine to drive a main thruster to generate a thrust and having a maximum value and a minimum value of a power range larger than a maximum value and a minimum value of a power range of the electric motor; and the controller is configured or programmed to:

limit the power range of the engine by matching an upper limit value of the power range of the engine with the maximum value of the power range of the electric motor while the main propulsion device and the auxiliary propulsion device are caused to cooperate with each other to move the hull; and limit the power range of the electric motor by matching a lower limit value of the power range of the electric motor with the minimum value of the power range of the engine while the main propulsion device and the auxiliary propulsion device are caused to cooperate with each other to move the hull.

17. The marine vessel according to claim 13, wherein the controller is configured or programmed to rotate the hull by driving the auxiliary thruster to generate the thrust from the auxiliary propulsion device while a main thruster operable to generate a thrust from the main propulsion device is stopped when the hull is rotated to maintain the orientation of the bow at the target orientation in the fixed point holding control.

18. The marine vessel according to claim 17, wherein the controller is configured or programmed to rotate the hull about a center of gravity of the hull on the spot while holding the position of the hull.

19. The marine vessel according to claim 13, wherein the controller is configured or programmed to, when the hull is moved to maintain the position of the hull at the target point in the fixed point holding control, move the hull laterally or diagonally while maintaining the orientation of the bow by simultaneously driving a main thruster to generate the thrust from the main propulsion device and the auxiliary thruster to generate the thrust from the auxiliary propulsion device, and move the hull in a forward-rearward direction by driving the main thruster while the auxiliary thruster is stopped.

20. The marine vessel according to claim 19, wherein the controller is configured or programmed to move the hull laterally or diagonally while maintaining the orientation of the bow by positioning an intersection of an output vector of the main thruster and an output vector of the auxiliary thruster on a straight line extending through a center of gravity of the hull and the target point and setting, in a direction from the center of gravity to the target point, a direction of a resultant force of the output vector of the main thruster and the output vector of the auxiliary thruster that indicates a moving direction of the hull.

* * * * *